US011684231B2

(12) United States Patent
Christian

(10) Patent No.: US 11,684,231 B2
(45) Date of Patent: Jun. 27, 2023

(54) CLEANING APPARATUS

(71) Applicant: Paul David Christian, Tampa, FL (US)

(72) Inventor: Paul David Christian, Tampa, FL (US)

( * ) Notice: Subject to any disclaimer, the term of this patent is extended or adjusted under 35 U.S.C. 154(b) by 0 days.

(21) Appl. No.: 17/838,093

(22) Filed: Jun. 10, 2022

(65) Prior Publication Data

US 2022/0313053 A1 Oct. 6, 2022

Related U.S. Application Data

(63) Continuation of application No. 16/847,423, filed on Apr. 13, 2020, now Pat. No. 11,375,871.

(51) Int. Cl.

| | |
|---|---|
| ***A47L 13/26*** | (2006.01) |
| ***A47L 13/16*** | (2006.01) |
| ***A47L 13/12*** | (2006.01) |
| ***A47L 13/51*** | (2006.01) |
| ***B08B 1/04*** | (2006.01) |
| ***B08B 1/00*** | (2006.01) |
| ***A46B 11/00*** | (2006.01) |

(52) U.S. Cl.

CPC ..... *A47L 13/26* (2013.01); *A46B 11/002* (2013.01); *A47L 13/16* (2013.01); *B08B 1/002* (2013.01); *B08B 1/04* (2013.01); *A47L 13/12* (2013.01); *A47L 13/51* (2013.01)

(58) Field of Classification Search

CPC .. B08B 1/04; B08B 1/002; B08B 1/00; B08B 1/001; B08B 1/006; A47L 13/26; A47L 13/16; A47L 13/10; A47L 13/12; A47L 13/00; A47L 13/28; A47L 13/42; A47L 13/50; A47L 13/51; A46B 11/002; A46B 11/001; A46B 11/0072; B05C 17/0205; B05C 17/02

USPC ..... 401/16, 18, 21, 123, 125

See application file for complete search history.

(56) References Cited

U.S. PATENT DOCUMENTS

| | | | | |
|---|---|---|---|---|
| 5,203,841 | A | 4/1993 | Kitabayashi | |
| 6,138,874 | A | 10/2000 | Audrey | |
| 6,216,920 | B1 * | 4/2001 | Baggett | B05B 11/0005 242/422.5 |
| 6,698,626 | B2 | 3/2004 | McKay | |
| 7,743,947 | B2 * | 6/2010 | Flasch | A47L 13/51 222/383.1 |
| 8,371,479 | B2 | 2/2013 | Luft | |
| 9,314,146 | B2 | 4/2016 | Gameiro et al. | |
| 9,365,320 | B1 | 6/2016 | Erickson | |

* cited by examiner

*Primary Examiner* — David J Walczak

(74) *Attorney, Agent, or Firm* — Perkins Coie LLP

(57) ABSTRACT

A cleaning device including a spray bottle, roller, and scrubber apparatus. The roller is positioned about the reservoir of the spray bottle. The removable scrubber is positioned in the base of the spray bottle. The roller uses a washable absorbent pad to clean surfaces with cleaning solution deposited by the spray bottle. The spray mechanism is held in two grips, a spray grip and a reverse grip in order to make use of the spray mechanism and the roller, respectively.

18 Claims, 11 Drawing Sheets

CLEANING APPARATUS

CROSS-REFERENCE TO RELATED APPLICATION(S)

This application is a continuation of U.S. patent application Ser. No. 16/847,423, filed on Apr. 13, 2020, entitled "CLEANING APPARATUS," which is incorporated herein by reference in its entirety.

TECHNICAL FIELD

This disclosure relates to cleaning apparatuses for athletic equipment. More particularly, but not exclusively, the disclosure relates to cleaning absorbent and padded surfaces such as those in yoga mats or weight lifting machines.

BACKGROUND

A yoga mat, exercise mats, or weight lifting machines are large surfaces and cleaning them thoroughly can be difficult. Spray bottles tend to add more liquid to the mat, and paper towels can be wasteful.

BRIEF DESCRIPTION OF THE DRAWINGS

One or more embodiments of the present disclosure are illustrated by way of example and not limitation in the figures of the accompanying drawings, in which like references indicate similar elements.

DETAILED DESCRIPTION

In this description, references to "an embodiment," "one embodiment" or the like, mean that the particular feature, function, structure or characteristic being described is included in at least one embodiment of the technique introduced here. Occurrences of such phrases in this specification do not necessarily all refer to the same embodiment. On the other hand, the embodiments referred to also are not necessarily mutually exclusive.

Currently, cleaning a yoga or exercise mat requires a spray bottle and some type of rag or towel. Disclosed herein is an apparatus that merges the cleaning surface and the spray bottle together. Embodiments of the cleaning apparatus are a modified spray bottle with a rotating sleeve attached to the body of the bottle. The sleeve and its attached surface are used to evenly distribute the liquid cleaner of the spray bottle like a rolling pin is used to flatten out dough. The cleaning apparatus simplifies cleaning of yoga or exercise mats versus the conventional approach of wiping the mats down by hand.

Figure 1:
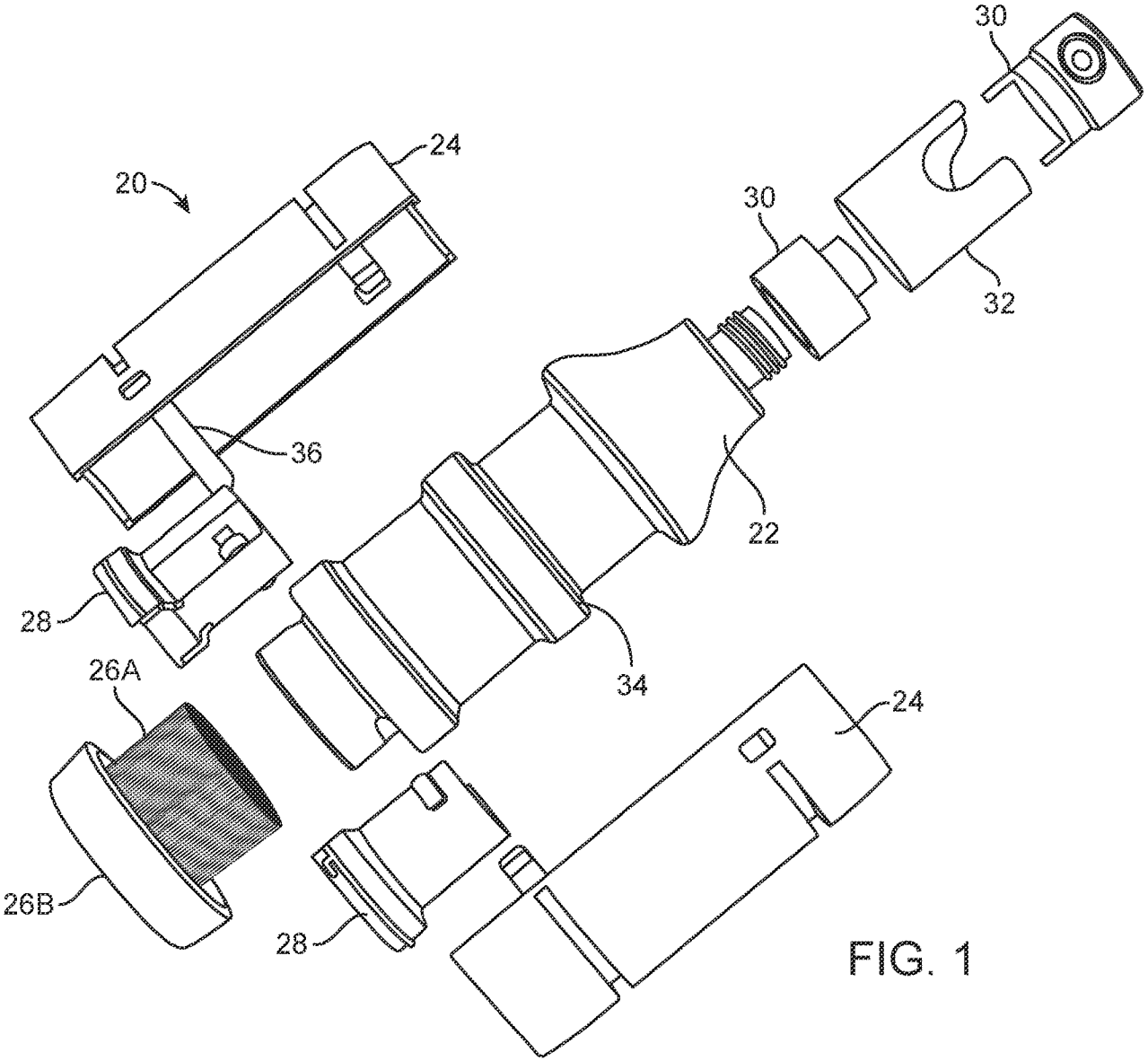
FIG. 1 illustrates an exploded view of a cleaning apparatus.

FIG. 1 illustrates an exploded view of a cleaning apparatus 20. The cleaning apparatus 20 includes a bottle or reservoir container 22, a rotating sleeve 24, a scrubber 26, a scrubber mount 28, a spray mechanism 30, and a spray handle 32.

The reservoir container 22 stores cleaning solution (e.g., water or other suitable solutions known in the art). The scrubber mount 28 is affixed to the base of the reservoir container 22 and enables a scrubber 26, including a scrubber brush 26A mounted in a scrubber cap 26B to mount to the cleaning apparatus 20.

The rotating sleeve 24 mounts to the reservoir container 22 and is configured to spin freely about the reservoir container 22. Rotation of the rotating sleeve 24 is directed by bottle ridges 34 and sleeve ridges 36. The respective ridges 34, 36 prevent shifting of the rotating sleeve 24 laterally toward a top and/or base end of the reservoir container 22.

The spray mechanism 30 mounts to the top end of the reservoir container 22 and includes a spray handle 32. The spray mechanism 30 delivers cleaning solution from within the reservoir container 22 to a workpiece (e.g., an athletic mat, weight lifting apparatus, countertops, or other suitable unclean surfaces). The spray handle 32 is configured to enable a user to hold the cleaning apparatus 20 in a spraying grip to spray the workpiece, and a reverse grip to make use of the rotating sleeve as a roller.

Figure 2:
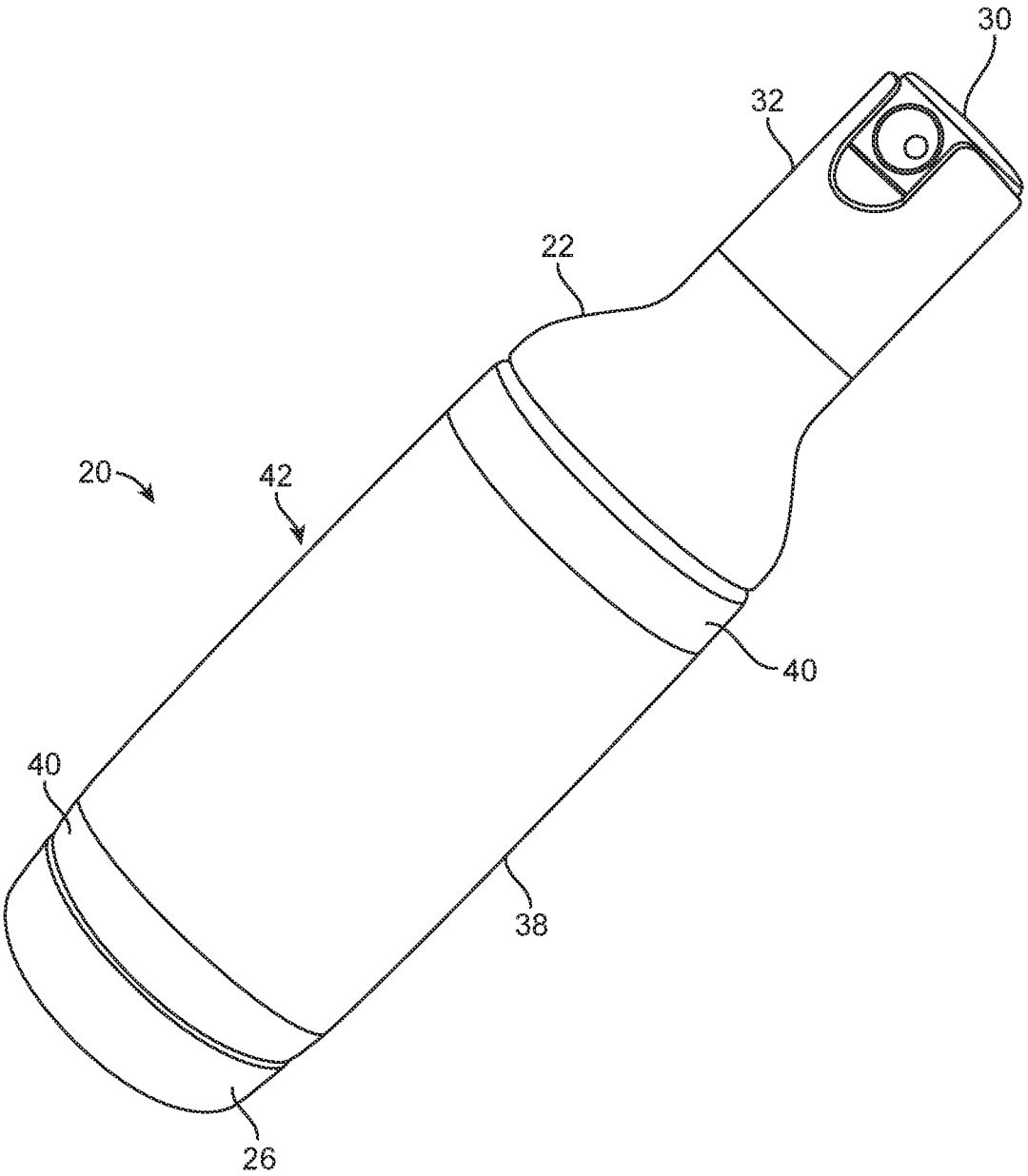
FIG. 2 illustrates an assembled view of a cleaning apparatus.

FIG. 2 illustrates an assembled view of a cleaning apparatus 20. Further pictured is an absorbent pad 38 wrapped around the rotating sleeve 24 (not pictured). The absorbent pad 38 comprises a washable (and thus reusable) material with elastic material 40 on its edges to force fit to the rotating sleeve 24. Some embodiments of the absorbent pad 38 include a mesh material. In some embodiments, the absorbent pad 38 is made from yoga mat material (e.g., PVC, vinyl, recycled rubber, and/or cotton). In some embodiments, the absorbent pad 38 is removable from the rotating sleeve 24 by sliding the absorbent pad 38 off the cleaning apparatus 20. In other embodiments, the absorbent pad 38 is affixed to the rotating sleeve 24 via a glue. The combination of the rotating sleeve 24 and the absorbent pad 38 create a roller 42 for the cleaning apparatus 20.

Figure 3:
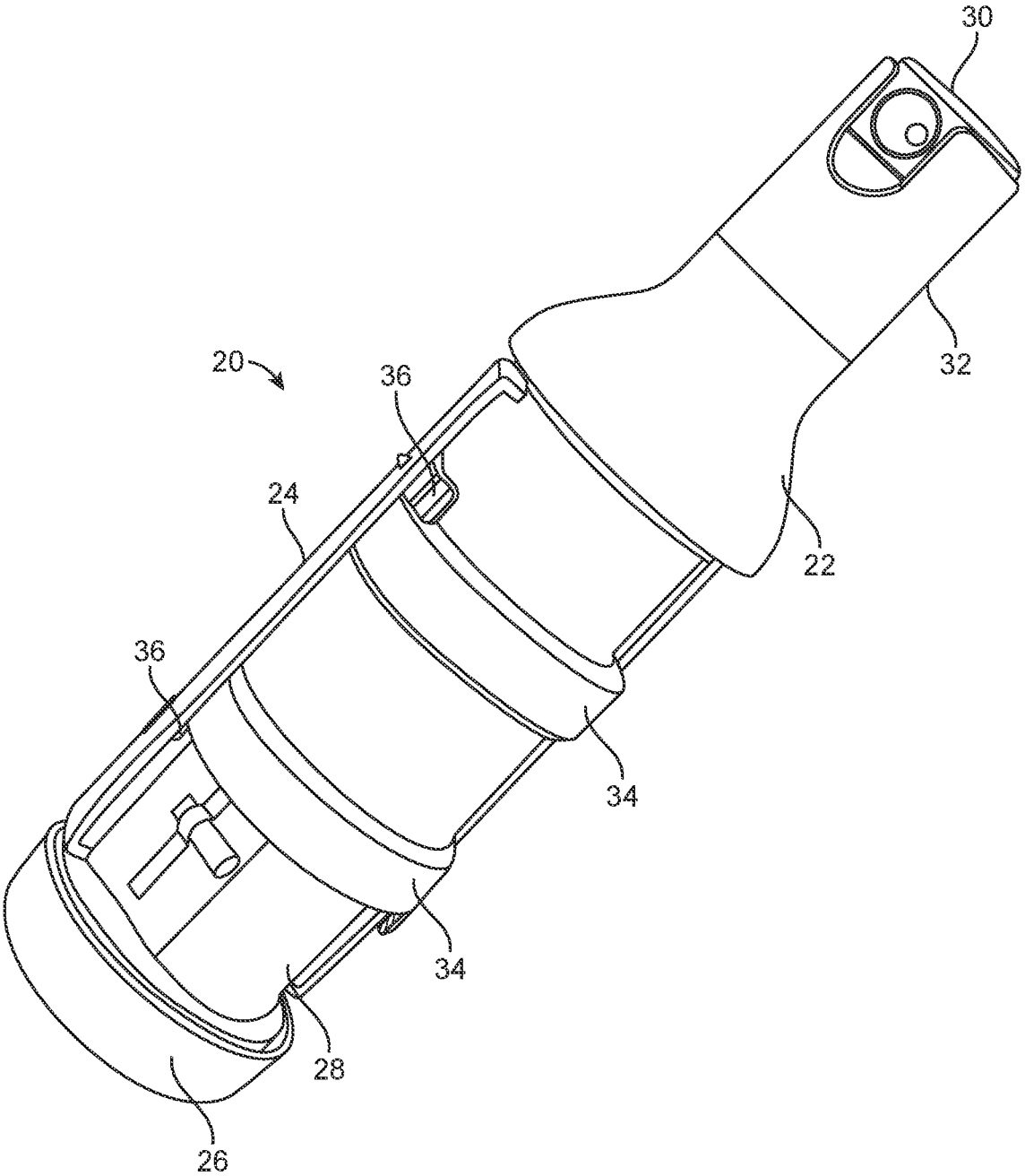
FIG. 3 illustrates a cross-sectional view of a roller of a cleaning apparatus.

FIG. 3 illustrates a cross-sectional view of a roller 42 of a cleaning apparatus 20. The pictured cross-section shows how the bottle ridges 34 and sleeve ridges 36 align to guide the roller 42. Additionally, the rotating sleeve 24 obscures view of the scrubber mount 28 from users.

Figure 4:
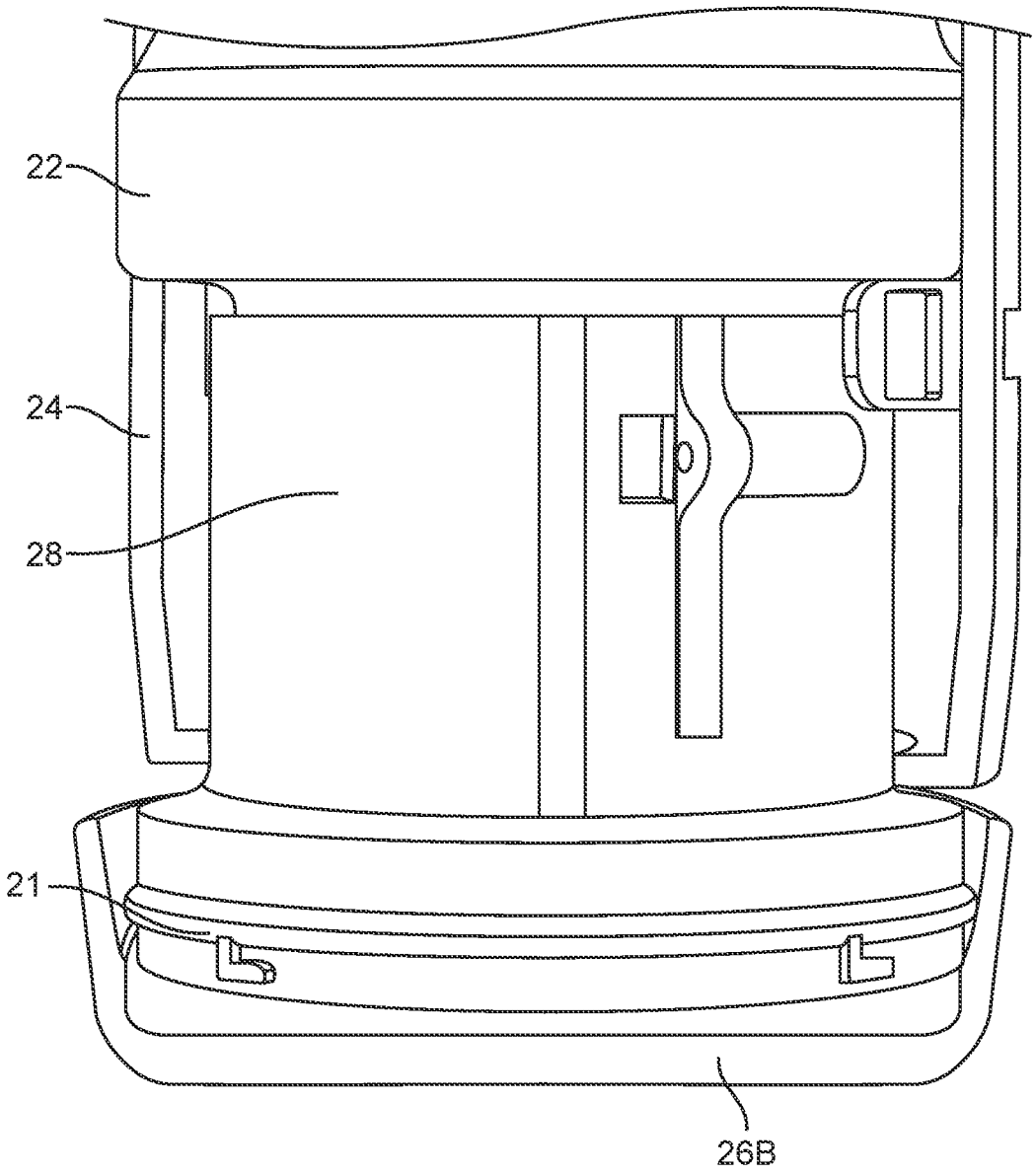
FIG. 4 illustrates a cross-sectional view of the base of a cleaning apparatus.

FIG. 4 illustrates a cross-sectional view of the base of a cleaning apparatus 20. The base of the cleaning apparatus 20 includes the scrubber cap 26B connection to the scrubber mount 28. The scrubber mount 28 includes a connection means 21. The connection means may include a force fit ridge, twist lock ridges, and/or screw threads for the scrubber cap 26B to latch on to.

Figure 5:
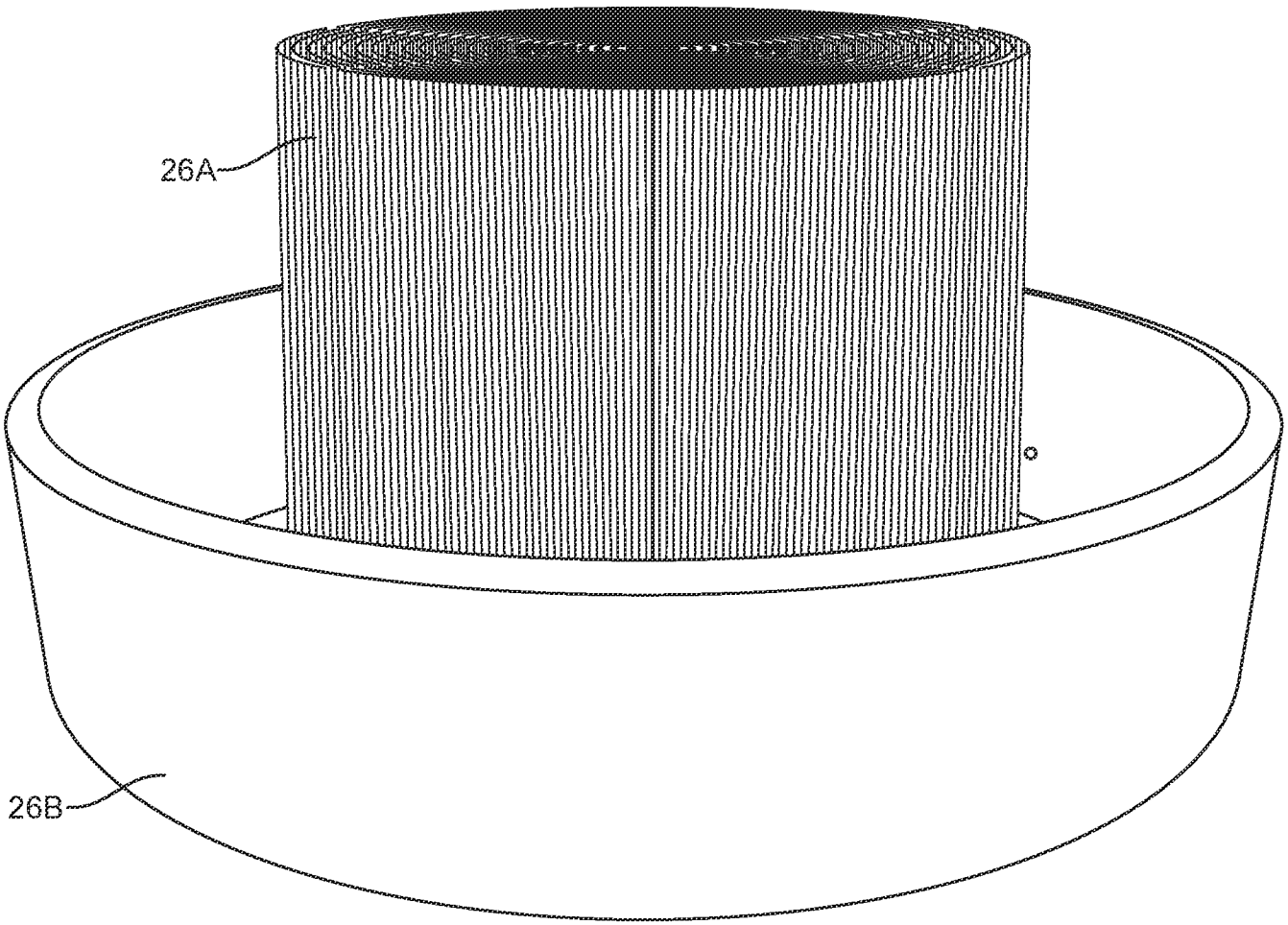
FIG. 5 illustrates a base-mounted scrubber of a cleaning apparatus.

FIG. 5 illustrates a base-mounted scrubber 26 of a cleaning apparatus 20. The scrubber 26 includes a scrubber brush 26A and a scrubber cap 26B. The scrubber brush 26A may comprise bristles, foam, silicone, sponge, and/or rubber. The scrubber brush 26A is embedded into the scrubber cap 26B.

Figure 6:
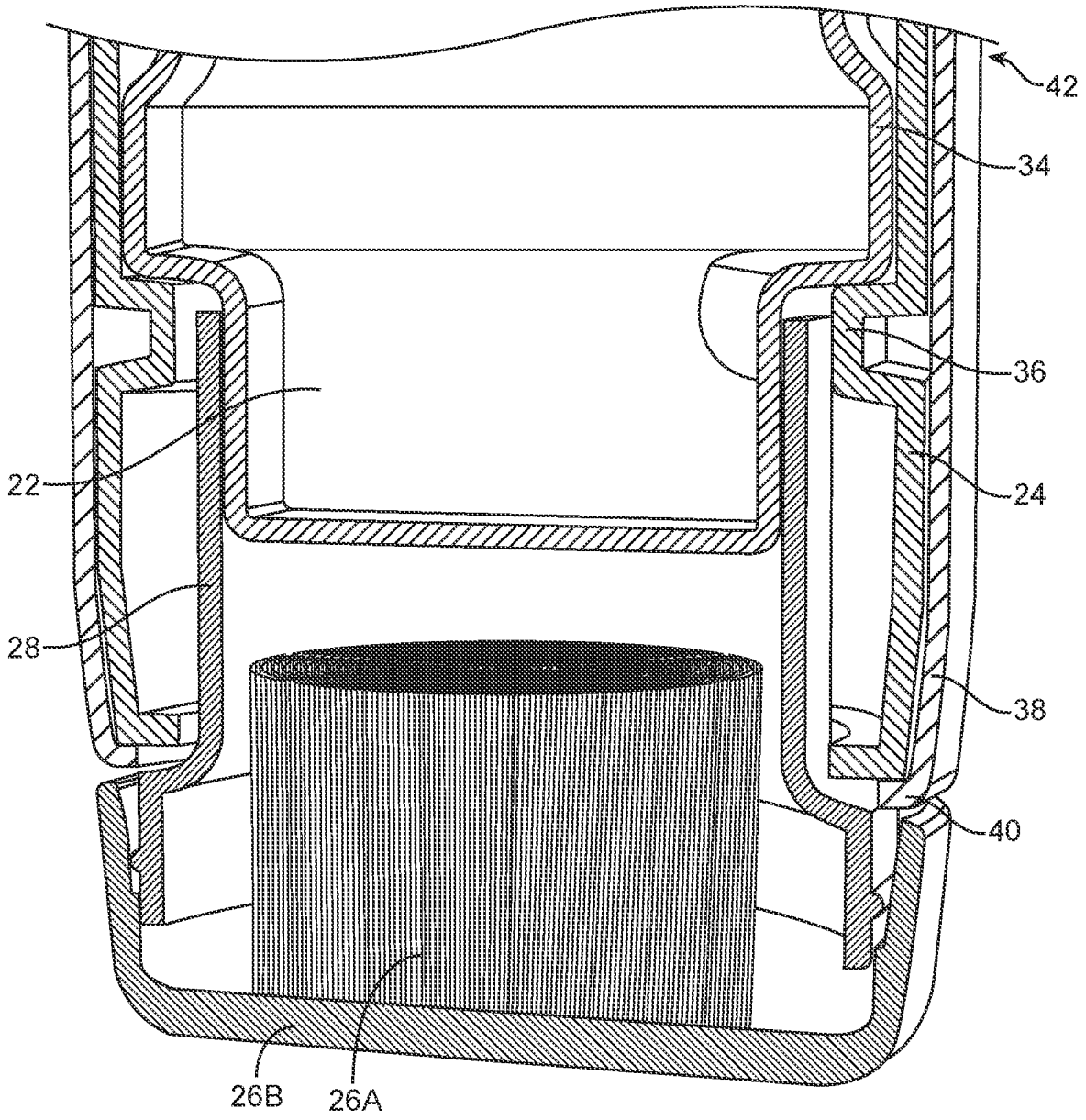
FIG. 6 illustrates a cross-sectional view of the base and roller of a cleaning apparatus.

FIG. 6 illustrates a cross-sectional view of the base and roller 42 of a cleaning apparatus 20. Depicted is the elastic material 40 of the absorbent pad 38 wrapped around an edge of the rotating sleeve 24. Further depicted is the scrubber brush 26A in a storage configuration within a compartment made by the scrubber mount 28.

Figure 7:
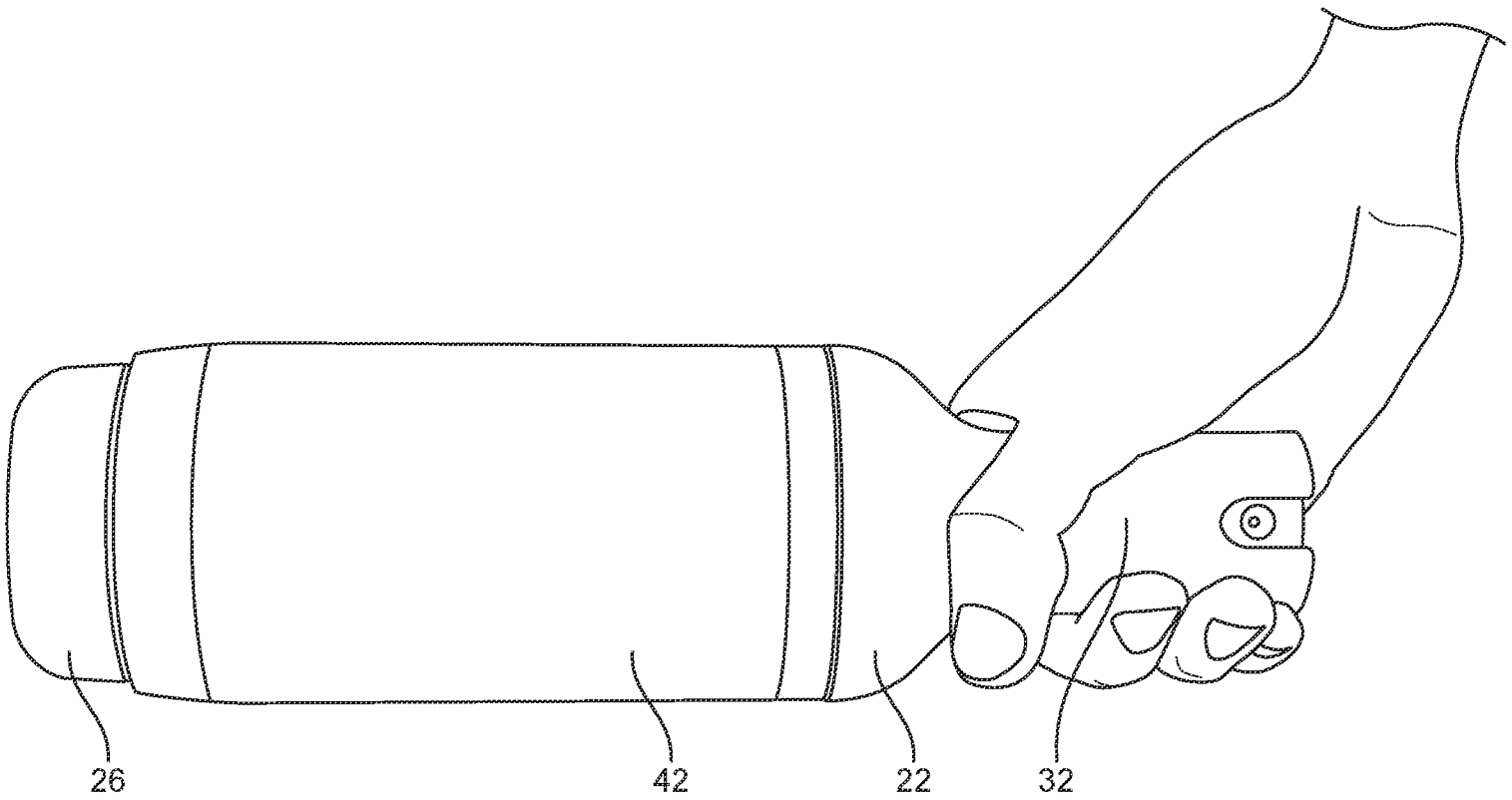
FIG. 7 illustrates a reverse grip of a cleaning apparatus.

FIG. 7 illustrates a reverse grip of a cleaning apparatus 20. The reverse grip enables the user to wield the reservoir container 22 and the cylindrical rotating sleeve 24 as a baton, and make use of the roller 42. The spray handle 32 is configured to be a length approximating a human palm to enable ease of use in either grip, the spray grip or the reverse grip.

Figure 8:
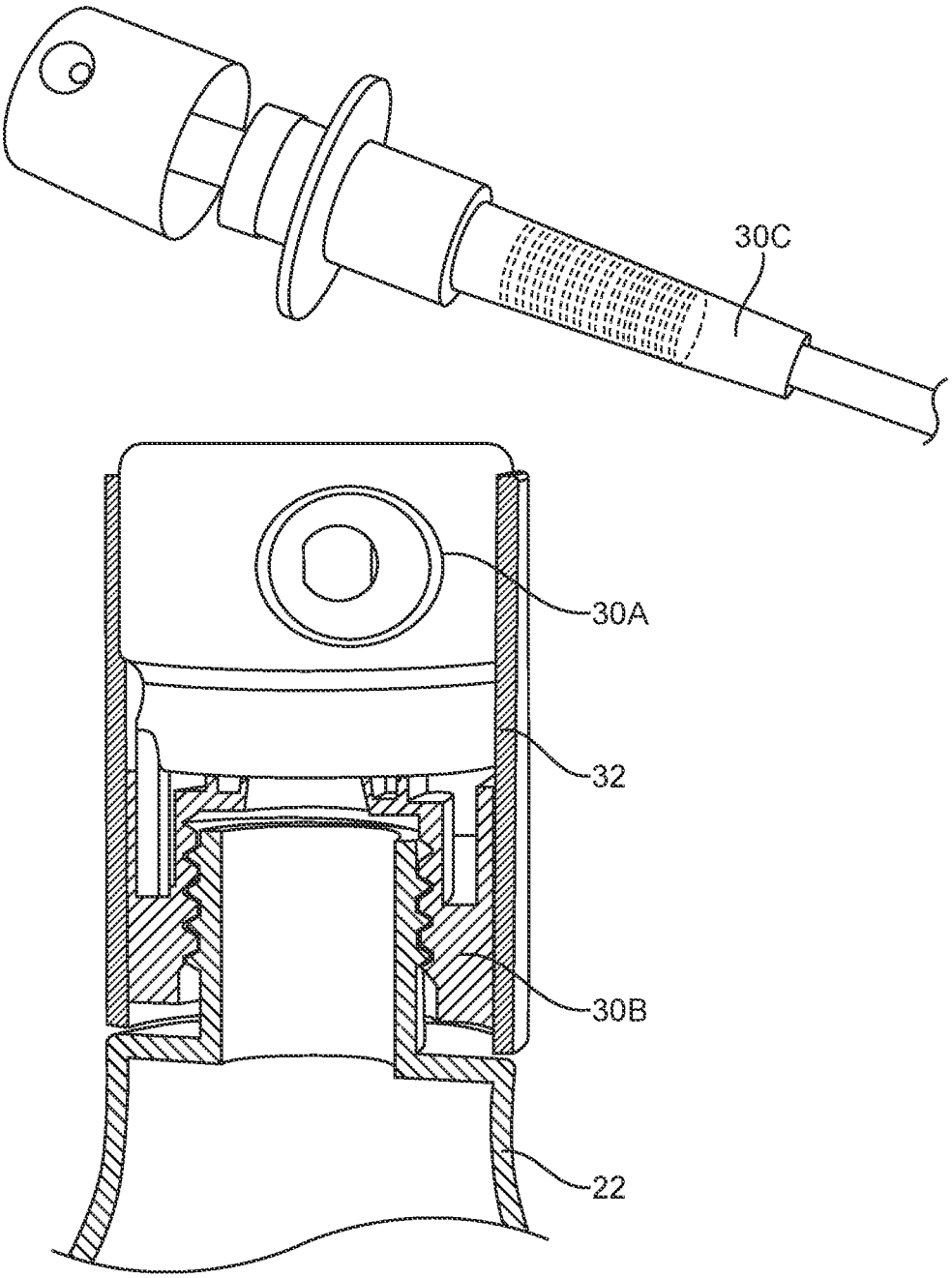
FIG. 8 illustrates a spray mechanism of a cleaning apparatus.

FIG. 8 illustrates a spray mechanism 30 of a cleaning apparatus 20. The spray mechanism 30 includes a spray nozzle 30A, a spray mount 30B, and a feed system 30C. The feed system 30C is a straw or hose connected to the spray mount 30B and the spray nozzle 30A with a spring-loaded plunger system. The spray handle 32 includes no moving parts. The spray handle 32 includes a gap where the spray nozzle 30A is accessible and activated. The spray nozzle 30A acts as a trigger for the spray mechanism 30 and does not protrude outside of the spray handle 32. The particular spray handle 32 and spray nozzle 30A configuration enables both the spray grip and the reverse grip without inadvertent activation of the spray mechanism 30.

Figure 9:
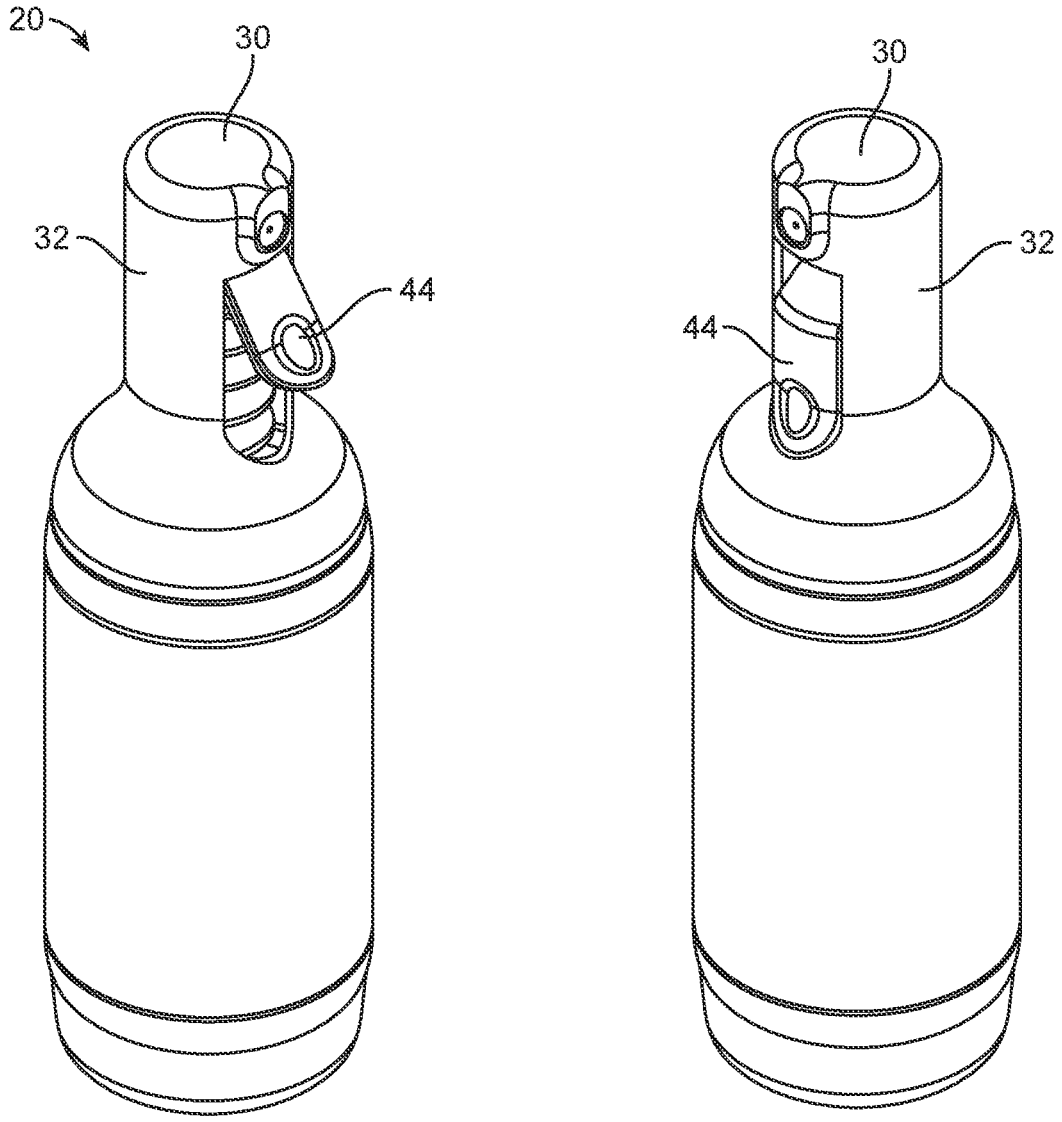
FIG. 9 illustrates an alternate spray mechanism of a cleaning apparatus.

FIG. 9 illustrates an alternate spray mechanism 44 of a cleaning apparatus 20. The alternate spray mechanism 44 uses a lever that when compressed becomes flush with the spray handle 32. The alternate spray mechanism 44 has more leverage than the spray mechanism 30; however, when extended, the alternate spray mechanism 44 is not flush with the spray handle 32. In some embodiments, the alternate spray mechanism 44 may be shifted in a direction other than the direction associated with the lever arm. Shifting the alternate spray mechanism 44 disengages the lever of the alternate spray mechanism 44 such that the lever may compress without causing the cleaning apparatus 20 to emit cleaning fluid. In this manner, the alternate spray mechanism 44 may become flush without undesired wetness.

In some embodiments, the spray handle 32 rotates laterally/twists and the rotation similarly disengages the lever of the alternate spray mechanism 44 to similarly enable the lever to lay flush with the spray handle 32.

Figure 10:
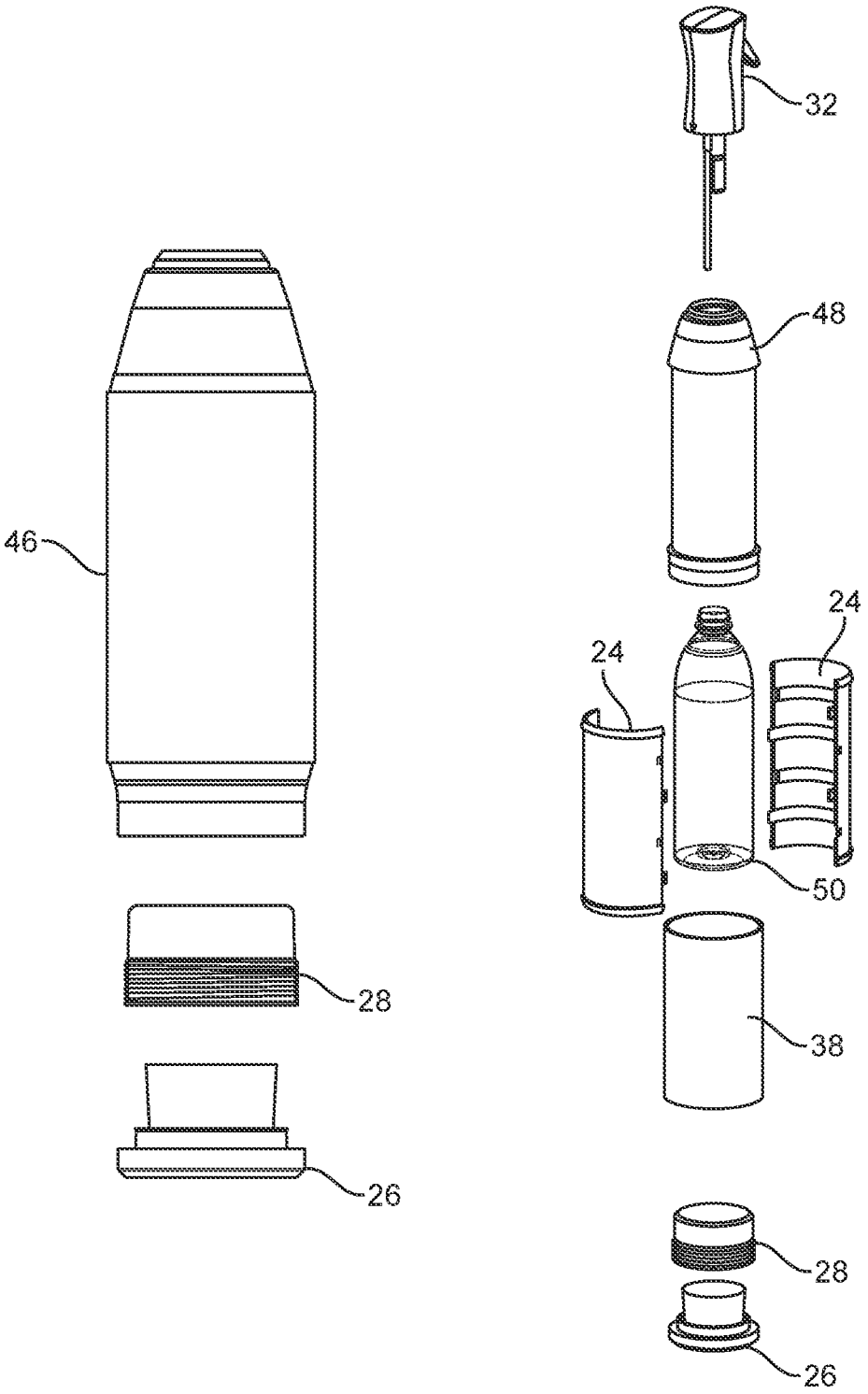
FIG. 10 illustrates a roller attachment associated with an existing spray bottle.

FIG. 10 illustrates a roller attachment 46 associated with an existing spray bottle 50. The roller attachment 46 is configured for use to adapt existing spray bottles to a similar apparatus as described in FIGS. 1-3.

In some embodiments, an external sheath 48 is affixed on top of an existing spray bottle 50. Attached to the external sheath 48 are two halves of a rotating sleeve 24. The absorbent pad 38 is positioned on top of the rotating sleeve 24. The scrubber mount 28 is affixed to the base of the external sheath 48 for attachment of the scrubber 26.

The existing spray bottle 50 is of any shape or design that the external sheath 48 fits around. In some embodiments, the existing spray bottle 50 is inserted into the bottom of the external sheath 48, while the spray handle 32 of the existing spray bottle 50 is unattached. The top of the existing spray bottle 50 goes through a hole in the top of the external sheath 48 and the spray handle 32 is attached to the top of the existing spray bottle 50. The spray handle 32 prevents the external sheath 48 from slipping off in one direction. The scrubber mount 28 caps the bottom of the external sheath 48 and prevents the external sheath 48 from slipping off in the other direction.

Figure 11:
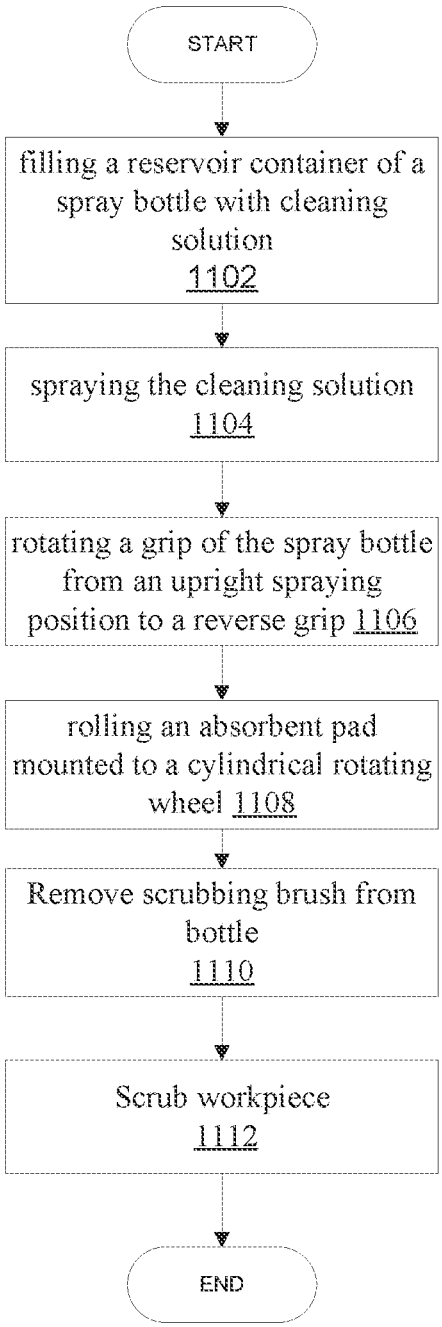
FIG. 11 is a flowchart illustrating use of a disclosed cleaning apparatus.

FIG. 11 is a flowchart illustrating use of a disclosed cleaning apparatus. In step 1102, the user fills a reservoir container of a spray bottle with cleaning solution. In step 1104, the user sprays the cleaning solution on a workpiece via a spray nozzle and feed system mounted to the reservoir container.

Once the workpiece is sprayed, in step 1106, the user rotates their grip of the spray bottle from an upright spraying position to a reverse grip that holds the reservoir container as a baton. In step 1108, the user rolls the absorbent pad mounted to the cylindrical rotating sleeve affixed to the exterior of the reservoir container across the workpiece.

In step 1110, the user removes a scrubbing brush from the spray bottle. The scrubbing brush is embedded into a removable base of the reservoir container. In step 1112, the user scrubs the workpiece with the scrubbing brush.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A spray bottle comprising:

a reservoir container;

a spray nozzle and feed system mounted to the reservoir container; and a cylindrical rotating sleeve affixed to an exterior of the reservoir container, the cylindrical rotating sleeve including an absorbent pad therearound comprising a washable material with elastic edges, the absorbent pad operable while attached to the cylindrical rotating sleeve.

2. The spray bottle of claim 1, further comprising:

a scrubbing brush embedded into a removable base of the reservoir container.

3. The spray bottle of claim 2, wherein the scrubbing brush further includes:

a scrubber that while attached to the spray bottle is oriented toward an inside of the reservoir container; and a cap that attaches to the removable base of the reservoir container via screw threads or force fit.

4. The spray bottle of claim 3, wherein the scrubber is replaceable.

5. The spray bottle of claim 1, wherein the absorbent pad is removable from the cylindrical rotating sleeve and configured to be washed and reused.

6. The spray bottle of claim 1, wherein the spray nozzle is cylindrical in shape and further includes a spray handle configured to be held in both of:

a spray grip that enables a user to activate the feed system and spray liquid from the reservoir container; and a reverse grip that wields the reservoir container and the cylindrical rotating sleeve as a baton.

7. The spray bottle of claim 6, wherein the spray handle has a length corresponding to a width of a human palm.

8. The spray bottle of claim 6, wherein the spray handle nozzle further includes:

an outer housing that includes no moving parts; and a trigger that is accessible through a gap in the outer housing.

9. The spray bottle of claim 1, wherein the reservoir container is configured to store a cleaning solution and the absorbent pad is configured to remove the cleaning solution from a workpiece.

10. The spray bottle of claim 9, wherein the workpiece is a yoga mat.

11. A system comprising:

a spray bottle including:

a reservoir container configured to store a cleaning solution;

a spray nozzle and feed system mounted to the reservoir container; and a cylindrical rotating sleeve affixed to an exterior of the reservoir container, the cylindrical rotating sleeve including an absorbent pad therearound comprising a washable material with elastic edges, the absorbent pad operable while attached to the cylindrical rotating sleeve; and a yoga mat that configured to transfer collected liquids into the absorbent pad.

12. The system of claim 11, further comprising:

a scrubbing brush embedding into a removable base of the reservoir container.

13. The system of claim 12, wherein the scrubbing brush further includes:

a scrubber that while attached to the spray bottle is oriented toward an inside of the reservoir container; and a cap that attaches to the removable base of the reservoir container via screw threads or force fit.

14. The system of claim 11, wherein the absorbent pad is removable from the cylindrical rotating sleeve and configured to be washed and reused.

15. The system of claim 11, wherein the spray nozzle is cylindrical in shape and further includes a spray handle configured to be held in both of:

a spray grip that enables a user to activate the feed system and spray liquid from the reservoir container; and a reverse grip that wields the reservoir container and the cylindrical rotating sleeve as a baton.

16. The system of claim 15, wherein the spray handle further includes:

an outer housing that includes no moving parts; and a trigger that is accessible through a gap in the outer housing.

17. A method comprising:

filling a reservoir container of a spray bottle with cleaning solution;

spraying the cleaning solution, on a workpiece, via a spray nozzle and feed system mounted to the reservoir container;

rotating a grip of the spray bottle from an upright spraying position to a reverse grip that holds the reservoir container as a baton; and rolling an absorbent pad mounted around a cylindrical rotating sleeve affixed to an exterior of the reservoir container across the workpiece, wherein the absorbent pad comprises a washable material with elastic edges.

18. The method of claim 17, further comprising:

removing a scrubbing brush from the spray bottle, the scrubbing brush embedded into a removable base of the reservoir container; and scrubbing the workpiece with the scrubbing brush.

* * * * *